United States Patent [19]

Bouffard et al.

[11] 3,996,447

[45] Dec. 7, 1976

[54] PTC RESISTANCE HEATER

[75] Inventors: Michael L. Bouffard, Pawtucket, R.I.; John L. Grant, Mansfield, Mass.

[73] Assignee: Texas Instruments Incorporated, Dallas, Tex.

[22] Filed: Nov. 29, 1974

[21] Appl. No.: 528,065

[52] U.S. Cl. ..... 219/541; 174/16 HS; 219/505; 219/534; 219/540; 219/544; 338/22 R; 338/328

[51] Int. Cl.[2] ..... H05B 3/02; H01C 7/02

[58] Field of Search ..... 219/200, 205, 210, 504, 219/505, 520, 530, 534, 535, 540, 541, 544, 552, 553; 73/362 AR; 174/DIG. 5, 15 R, 16 HS; 338/22–25, 28–30, 204, 205, 233, 229, 271, 273, 274, 306, 314, 322, 327, 328, 329, 333, 334

[56] References Cited

UNITED STATES PATENTS

| | | | |
|---|---|---|---|
| 2,606,986 | 8/1952 | Sweger | 338/23 X |
| 2,880,295 | 3/1959 | Huffman | 338/328 X |
| 2,933,708 | 4/1960 | Elliot et al. | 338/28 |
| 2,967,984 | 1/1961 | Jamison | 219/540 UX |
| 2,988,717 | 6/1961 | Bergsma | 73/362 AR |
| 3,391,242 | 7/1968 | Sudges | 174/15 R |
| 3,430,336 | 3/1969 | Riddel | 338/22 R |
| 3,584,189 | 6/1971 | Marcoux | 219/504 X |
| 3,720,807 | 3/1973 | Ting | 338/22 R |

*Primary Examiner*—A. Bartis
*Attorney, Agent, or Firm*—John A. Haug; James P. McAndrews; Russell E. Baumann

[57] ABSTRACT

An electrical heater device includes a disc-like ceramic resistor element of a material of positive temperature coefficient of resistivity having contact surfaces formed on a broad opposite sides of the element. A pair of device terminals engage respective contact surfaces of the resistor element for directing electrical current through the element. At least one of the terminals has a plurality of protuberances resiliently engaged with a limited area of one contact surface of the resistor element to provide good electrical connection to the element in a convenient manner. In addition, an inert silicone material having a metallic particulate dispersed therein is disposed between the terminal and the remaining area of the contact surface of the resistor element to maximize heat transfer from the element to the terminal so that heat generated by the resistor element is efficiently emitted from the heater device.

6 Claims, 4 Drawing Figures

PTC HEATING ELMENT

HIGH THERMAL CONDUCTIVITY SILICONE GREASE

PTC RESISTANCE HEATER

BACKGROUND OF THE INVENTION

Ceramic resistor materials such as doped barium titanates of positive temperature coefficient of resistivity have been used or proposed for use in a wide variety of applications as self-regulating electrical resistance heaters. A resistor element made from such a ceramic material noramlly displays relatively low electrical resistance at room temperature, for example, and then displays a small increase in resistivity as the element is initially heated by directing electrical current through the element. However, when the element has been self-heated in this manner to a selected temperature which is characteristic of the ceramic material, the element displays a very large and sharp increase in resistance and reduces current through the element to a very low level which is just sufficient to maintain the element at an equilibrium temperature. In this way, the resistance element provides a substantial amount of heat but is self-regulating to avoid excessive overheating of the resistance element.

Such ceramic resistor elements are commonly used in thin disc-like form. The broad flat surfaces of the disc element are then provided with very thin metallized coatings or the like so that the broad element surfaces serve as contact surfaces for directing electrical current through all parts of the ceramic material in the element. In this way, all parts of the ceramic element material tend to be heated substantially simultaneously to the selected temperature at which the ceramic material displays its sharp increase in resistivity. However, in this arrangement, the broad contact surfaces of the resistor element also constitute the principle heat-emitting surfaces of the element. Accordingly, the means commonly employed for making electrical connection to the contact surfaces of the resistor element can retard emission of heat from these element surfaces. Further, the means used in making electrical connecton to these element surfaces have frequently tended to cause degradation of the electrical properties of the ceramic constituents of the resistor element. These factors have tended to result in a significantly reduced total heat output from a heater device utilizing such a ceramic resistor element and have frequently caused the heater device to have a relatively short service life. For example, where the broad contact surfaces of such ceramic resistor element are secured to heater device terminals by the use of electrically conducting adhesives, the layers of adhesive formed on the resistor surfaces can have a thermal barrier effect for retarding heat emission from the resistor element. More important, such adhesives have tended to cause degradation of the resistance properties of the element materials. Similarly, where terminals have been soldered to the contact surfaces of the resistor element, the fluxes used in making such solder connections have also tended to cause degradation of the ceramic materials of the resistor element. Alternately, where metal terminals are resiliently held in engagement with the contact surfaces of the resistor element in a construction which is both economical and convenient to assemble, it is frequently found that either poor electrical engagement is achieved between the terminal and the element or there is poor heat transfer from the element to the terminal so that heat emission from the resistor element is considerably retarded.

It is an object of this invention to provide a novel and improved electrical resistance heater device; to provide such a device which is characterized by a long service life; to provide such a device which is of convenient and economical construction; to provide such a device utilizing a ceramic resistor element of positive temperature coefficient of resistivity wherein good electrical engagement with the resistor element is conveniently obtained with improved heat emission from the resistor element; and to provide such an improved heater device which is compact, rugged and reliable in use.

Other objects, advantages and details of the improved heater device of this invention appear in the following detailed description of preferred embodiments of the invention, the detailed description referring to the drawing in which.

Figure 1:
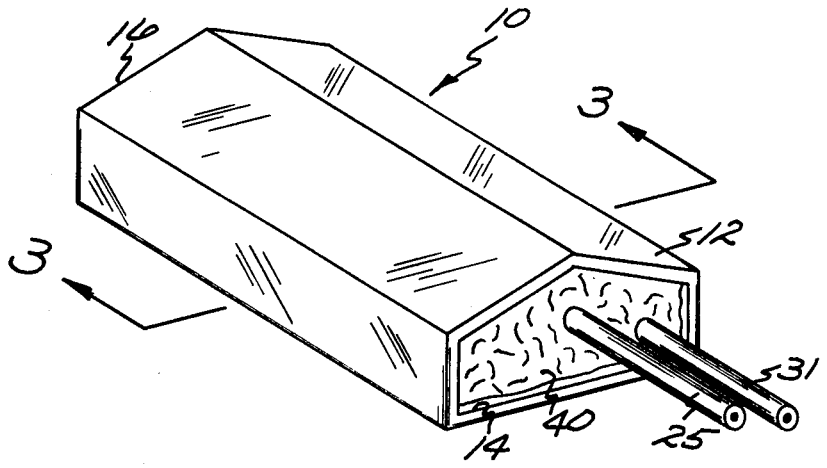
FIG. 1 is a perspective view of the electrical resistance heater device of this invention.
Figure 3:
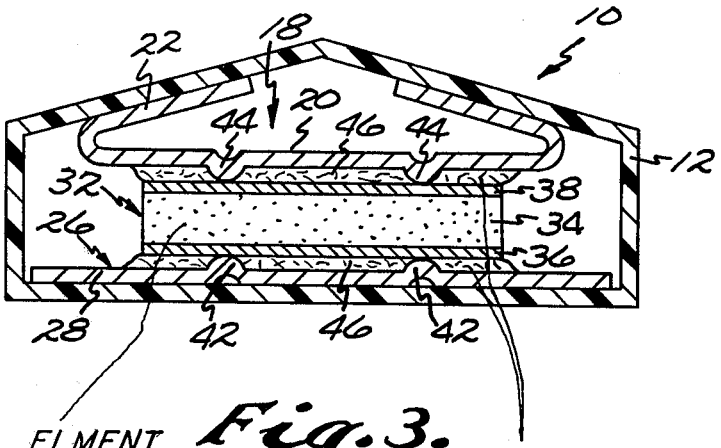
FIG. 3 is a section view to enlarged scale along line 3—3 of FIG. 1.

Referring to the drawing, 10 in FIGS. 1 and 3 indicates the novel and improved electrical heater device of this invention which is shown to incorporate a casing 12 of electrically insulating material having an open end 14 and a closed end 16.

The device also includes a first electrically conductive metal terminal 18 having a plate portion 20, a pair of integral spring portions 22 extending obliquely from edges of the plate portion of the first terminal, and a connector portion 24 located at one end of the first terminal. Perferably the first terminal 18 is formed of an electrically conductive spring material such as beryllium copper.

Also incorporated in the device 10 is a second terminal 26 having a plate portion 28 of electrically conductive metal material and having a connector portion 30 located at a corresponding end of the second terminal. Preferably the second terminal is formed of an electrically conductive material such as copper having a relatively high thermal conductivity.

Figure 2:
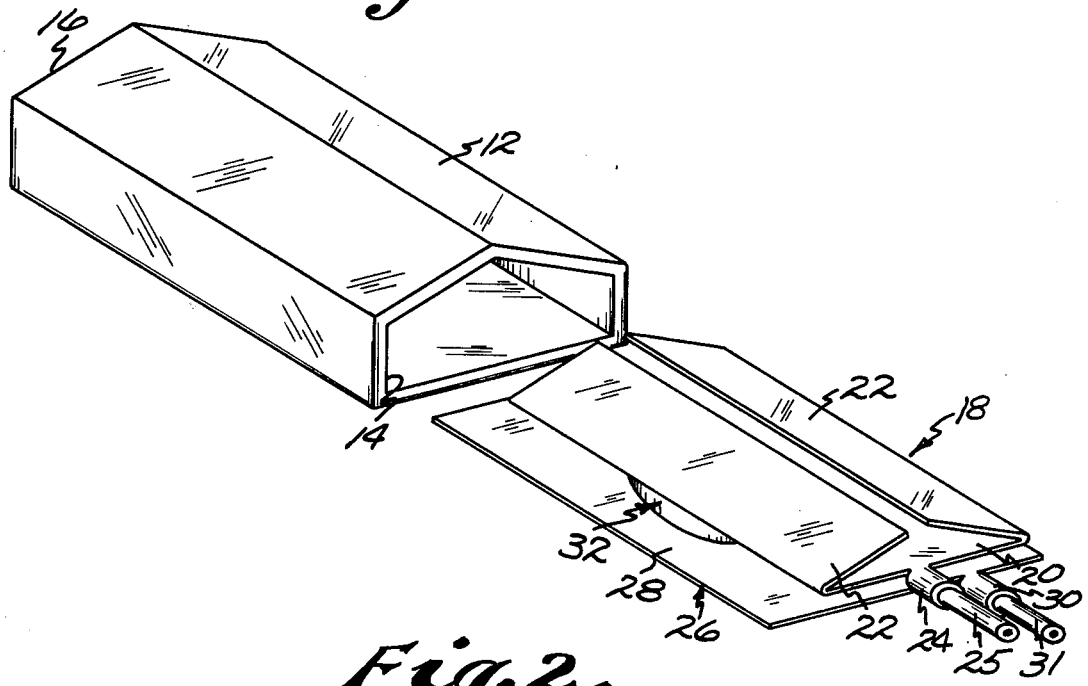
FIG. 2 is a perspective view of components of the device of FIG. 1 illustrating steps in the assembly of the device.

As shown in FIGS. 1 and 2, power leads 25 and 31 are secured to the connector portions of the terminals 18 and 26 in any conventional manner.

The heater device 10 of this invention further includes a self-regulating electrical resistance heater element 32 as shown in FIGS. 2 and 3. As shown in FIG. 3, the resistor element incorporates a layer 34 of a ceramic material which has a relatively low electrical resistance at a selected temperature such as room temperature and which has a positive temperature coefficient of resistivity such that, as the ceramic material is heated to an anomaly temperature characteristic of the particular ceramic material, the material displays a sharp and very large increase in resistivity. Such ceramic resistor materials of positive temperature coefficient of resistivity include various semiconducting titanates, zirconates and stannates with and without silicon additives. Such materials include barium, calcium, strontium and lead titanates or the like having various rare earth dopants such as lanthanum and yttrium. Typically, for example, the ceramic layer 34 of the resistor element is formed of a lanthanum-doped barium titanate having the formula $Ba_{.998}La_{.002}TiO_3$ and has a relatively low electrical resistance on the order of 550 to 1000 ohms at 25° C. but is adapted to display a sharp increase in resistance at an anomaly temperature of about 115° C. When heated to an equilibrium temperature, a layer of such ceramic material typically displays a resistance on an order of 50,000ohms. As such ceramic resistor materials of positive temperature coefficient of resistivity which display sharply increased resistance at an anomaly temperature are well know, they are not further described herein. However, it will be understood that, when electrical current in directed through a layer 34 of such a ceramic material, the material is self-heated due to its internal resistance. In turn, as the material is heated, the material increases in resistance for reducing the current flow through the ceramic layer. In this way, the material displays increased resistance as it is heated until it reaches an equilibrium or self-regulated temperature at which the current in the material is reduced to a very low level just sufficient to maintain the material at the equilibrium temperature. That is, at this temperature, the heat generated in the ceramic material by the current through the material just balances the heat dissipated from the material.

As indicated in the drawings, the resistance element 32 is preferably of a very thin disc-like configuration on the order of 0.200 inches thick and is typically, but not necessarily, of round configuration having broad, flat and substantially parallel surfaces on the opposite sides of the ceramic layer. Each of these broad, flat surfaces on the ceramic layer are provided with a layer 36, 38 of electrically conductive metal material forming ohmic contact surfaces on the ceramic layer. Typically the contact layers 36 and 38 are formed of flame-sprayed aluminum or of layers of copper flame-sprayed onto flame-sprayed layers of aluminum so that the metal layers are directly adherent to the ceramic layer 34. As shown in FIG. 3, these electrically conductive contact layers 36 and 38 do not extend along the edges of the ceramic layer 34.

Figure 4:
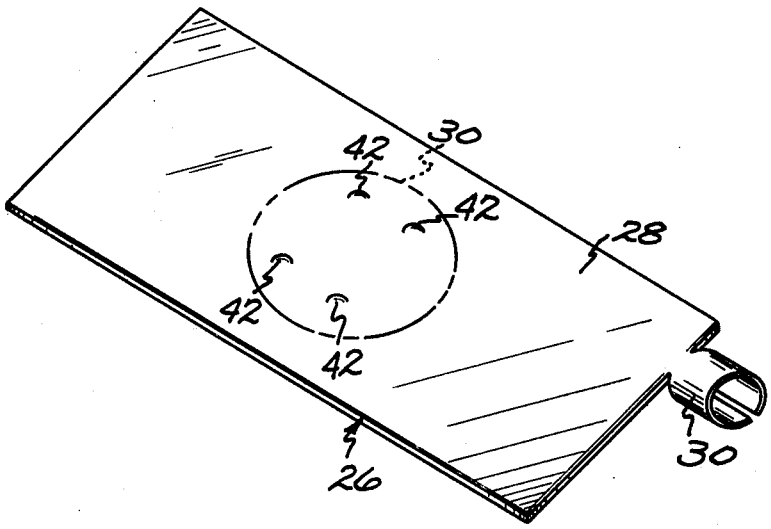
FIG. 4 is a perspective view of one component of the device of FIG. 1.

The features of the switch 10 as thus far described are conventional and are shown in the commonly assigned copending application, Ser. No. 484,850, Filed July 1, 1974, now U.S. Pat. No. 3,940,591, granted Feb. 24, 1976, the disclosure of which is incorporated herein by this reference. In accordance with this invention, however, at least the plate portion 28 of the second device terminal 26 is provided with a plurality of protuberances 42 on one side of the terminal plate portion. Preferably, for example, these protuberances are formed on one side of the terminal plate portion 28 as shown in FIGS. 3 and 4 by dimpling the opposite side of the terminal plate portion. If desired, the plate portion 20 of the first terminal 18 is also provided with similar protuberances 44 as illustrated in FIG. 3. Typically, the protuberances 42 and 44 extend about 0.005 to 0.013 inches above the general plane of the plate portions of the terminals 18 and 26. Further, as shown in FIG. 4, the protuberances 42 and 44 are preferably confined to limited areas of the terminal plate portions to be subsequently engaged with contact surfaces of the resistor element 32.

In accordance with this invention, the areas of the terminals 18 and 26 on which the protuberances 42 and 44 are formed are then coated with a silicone-base material as indicated at 46 in FIG. 3, this silicone-base material having a metallic particulate dispersed therein providing the material with a suitably high thermal conductivity. The material 46 includes any of the various silicone materials such as dimethyl silicone and various other methyl-alkyl silicones which are chemically inert with respect to the noted ceramic materials embodied in the resistor element 32 and which are substantially stable and shape-retaining at temperatures in the range from about 100° to 160° C. The material 46 also includes either metallic oxide particulates such as zinc oxide or aluminum oxide as well as various metal powders such as copper, nickel, aluminum, silver or graphite or the like, the metallic particulate comprising from about 5 to about 60 percent by weight of the material 46. Typically, for example, the silicone used in the silicone-based material 46 comprises dimethyl silicone having a zinc oxide particulate dispersed therein comprising about 55 percent by weight of the material 46, such a material being chemically inert with respect to the ceramic materials of the layer 34 in the resistor element 32 as noted above, having a thermal conductivity of $2.2 \times 10^{-3}$ calories per second per square centimeter per degree C. for a thickness of 1 centimeter, and retaining its thermal and shape-retaining properties over a period of several months even when retained at a temperature of about 140° C. for such a period of time.

As shown in FIGS. 2 and 3, the resistor element 32 is then disposed between the terminals 18 and 26 of the device 10 so that the contact surfaces 36 and 38 of the resistor element are respectively engaged with the protuberances 42 and 44 on the device terminals. Then, as will be understood, the device terminals and the resistor element 32 are slid into the casing 12 and the open end 14 on the casing is sealed with any suitable sealing material as indicated at 48 in FIG. 1. Typically, for example, the sealing material is an electrically insulating room temperature vulcanizing rubber material and a flow of the sealant into the casing 12 is limited by insertion of an insulating paper member (not shown) into the open casing end 14 before application of the sealant 48, thereby to retain the sealant at the open end of the casing.

In this arrangement, insertion of the terminals into the casing 12 brings the spring portions 22 of the first terminal into contact with the casing for resiliently biasing the protuberances 42 and 44 on the terminals 18 and 26 into firm electrical engagement with limited areas of the contact surfaces 36 and 38 respectively of the resistor element 32 and for also resiliently biasing the terminal 26 firmly against the casing 12. In this way, the protuberances 42 and 44 assure that good electrical contact is obtained between the device terminals and the resistor element, the point-like contact between the protuberances and the contact layers 36 and 38 being obtained through the silicone grease coating as a result of the resilient pressure of the terminals against the resistor element. At the same time, the silicone grease material 46 fills the spaces between the terminals 18 and 26 and the remaining areas of the contact layers 36 and 38 on the resistor element, thereby assuring that, when the resistor element 32 is electrically self-heated, there is good heat transfer contact between the resistor element and the device terminals. As will be understood, the grease-like nature of the silicone-based material 46 and the resilient biasing of the terminals 18 and 26 toward the resistor element 32 assure that this good heat transfer relation between element and terminals is maintained even though the element 32 is subject to some expansion and contraction as the element is subjected to intermittent heating and cooling. The grease-like nature of the silicone-based material and the resilient biasing of the terminals also assures that there is good heat transfer between the element and the terminals during such expansion and contraction of the resistor element.

Desirably, at least the terminal 26 is provided with a substantially greater size relative to the resistor element 32 so that the terminal 26 serves as a heat-sink member for rapidly withdrawing heat from the resistor element as it is generated by the element and for enchancing emission of this heat from the large surface area of the terminal 26 to maximize heat output by the heater device 10. The inert nature of the silicone-based coating 46 assures that the coating does not react with the ceramic material 34 of the resistor element even though the contact layers 36 and 38 formed on the element may be characterized by substantial porosity. Thus, the ceramic material does not tend to degrade and the device 10 displays a long service life even when retained at elevated temperatures on the order of 140° C. and the like throughout a large portion of this service life. Similarly, the shape-retaining nature of the silicone-based coating 46 assures that good heat transfer is maintained between the resistor element 32 and at least the terminal 26 throughout this long service life. Further, as the silicone-based material 46 is not strongly adherent to the resistor element 32 or the terminals 18 and 26, the material 46 is easily and conveniently used in device assembly without risk of incorrect component assembly resulting in loss of any device components. That is, where the device terminals are resiliently held in engagement with the resistor element 32, any device components which are damaged during assembly such as might occur if one of the device terminals were bent during insertion into the casing 12 does not require that the resistor element and the other device terminal be discarded. Thus assembly costs for the device 10 are relatively low.

It should be understood that although various embodiments of the heater device of this invention have been described by way of illustrating the invention, this invention includes all modifications and equivalents of the disclosed embodiments falling within the scope of the appended claims.

We claim:

1. A self-regulating electrical heater device comprising a casing, a resistor element of disc-like configuration disposed within said casing, said resistor element having a layer of a ceramic material of selected thickness and of positive temperature coefficient of resistivity which displays a sharp increase in resistivity when heated to a selected temperature by directing electrical current through said ceramic layer for regulating the heated temperature of said element, said layer of ceramic material having flat surfaces on respective opposite sides thereof which are broad relative to said ceramic layer thickness and having metal layers on said broad flat surfaces providing electrical contact surfaces on said opposite sides of said ceramic layer, pair of electrically conducting metal terminals disposed within said casing adjacent said respective contact surfaces of said resistance element, a silicone material having a metallic particulate dispersed therein disposed to substantially fill the space between at least one of said terminals and the one contact surface of said element adjacent to said one terminal to provide improved heat-transfer to said one terminal from a selected area of said element contact srface, said one terminal having a plurality of protuberances in a selected pattern thereon extending through said silicone material into electrical engagement with selected spaced areas of said one contact surface, and means cooperating with said casing for resiliently biasing said one terminal to maintain said protuberances extending through said silicone material into said electrical engagement with said one terminal and for disposing the other of said contact surfaces in electrical engagement with the other of said terminals.

2. An electrical heater device as set forth in claim 1 wherein said ceramic material is selected from the group consisting of semiconducting titanates, zirconates and stanates.

3. An electrical heater device as set forth in claim 2 wherein said ceramic material selected from the group consisting of semiconducting barium, calcium, strontium and lead titanates.

4. An electrical heater device as set forth in claim 3 wherein said ceramic material incorporates a dopant selected from the group consisting of lanthanum and yttrium.

5. An electrical heater device as set forth in claim 4 wherein said silicone material is selected from the group consisting of methyl-alkyl silicones.

6. An electrical heater device as set forth in claim 5 wherein said metallic particulate is selected from the group of particulate materials consisting of zinc oxide, aluminum oxide, copper, nickel, aluminum, silver and graphite.

* * * * *